US008353274B2

(12) United States Patent
Klipfel et al.

(10) Patent No.: US 8,353,274 B2
(45) Date of Patent: Jan. 15, 2013

(54) EXHAUST GAS RECIRCULATION SYSTEM

(75) Inventors: Bernhard Klipfel, Karlsruhe (DE); Christoph Thiery, Mannheim (DE); Jan Helber, Balingen (DE)

(73) Assignee: Cooper-Standard Automotive (Deutschland) GmbH, Schelklingen (DE)

( * ) Notice: Subject to any disclaimer, the term of this patent is extended or adjusted under 35 U.S.C. 154(b) by 62 days.

(21) Appl. No.: 12/182,029

(22) Filed: Jul. 29, 2008

(65) Prior Publication Data

US 2009/0139502 A1 Jun. 4, 2009

(51) Int. Cl.
*F02B 47/08* (2006.01)

(52) U.S. Cl. ..... 123/568.12; 123/568.24; 60/324

(58) Field of Classification Search ..... 60/324; 123/568.11, 568.12, 568.21, 568.23–568.26, 123/568.29, 336; 165/103
See application file for complete search history.

(56) References Cited

U.S. PATENT DOCUMENTS

| | | | | |
|---|---|---|---|---|
| 4,823,748 | A * | 4/1989 | Ampferer et al. | 123/336 |
| 6,000,222 | A * | 12/1999 | Regnier | 60/605.2 |
| 6,213,105 | B1 | 4/2001 | Bonzhaf et al. | |
| 6,484,706 | B1 * | 11/2002 | Mate | 123/583 |
| 6,823,838 | B2 * | 11/2004 | Koch et al. | 123/336 |
| 6,843,239 | B2 * | 1/2005 | Fensom et al. | 123/568.21 |
| 6,976,480 | B2 * | 12/2005 | Miyoshi et al. | 123/568.12 |
| 7,021,288 | B2 * | 4/2006 | Asano et al. | 123/435 |
| 7,036,565 | B2 * | 5/2006 | Brost et al. | 165/103 |
| 7,320,220 | B1 * | 1/2008 | Atkinson | 60/605.2 |
| 2003/0015184 | A1 | 1/2003 | Klipfel et al. | |
| 2004/0256086 | A1 | 12/2004 | Brost | |
| 2005/0000491 | A1 | 1/2005 | Burger et al. | |
| 2005/0167629 | A1 | 8/2005 | Thiery et al. | |
| 2005/0199381 | A1 * | 9/2005 | Mercz et al. | 165/172 |
| 2008/0104950 | A1 * | 5/2008 | Palanchon et al. | 60/324 |
| 2008/0184974 | A1 * | 8/2008 | Kobayashi et al. | 123/568.12 |
| 2009/0235654 | A1 * | 9/2009 | Kobayashi et al. | 60/324 |
| 2009/0260604 | A1 * | 10/2009 | Castano Gonzalez et al. | 123/568.12 |

FOREIGN PATENT DOCUMENTS

| | | | |
|---|---|---|---|
| DE | 10 2004 040 818 | A1 | 3/2006 |
| DE | 10 2005 033 601 | A1 | 1/2007 |
| EP | 1 126 156 | | 8/2001 |
| EP | 0 916 837 | | 3/2002 |
| EP | 1217233 | A1 | 6/2002 |
| EP | 1 245 820 | A1 | 10/2002 |
| EP | 1 251 263 | A2 | 10/2002 |
| EP | 1 277 945 | A1 | 1/2003 |
| EP | 1 462 643 | A1 | 9/2004 |
| EP | 1 544 449 | A1 | 6/2005 |
| EP | 1 245 820 | B1 | 2/2006 |
| EP | 1 640 593 | A1 | 3/2006 |
| EP | 1 707 790 | A1 | 10/2006 |
| JP | 9-88727 | | 3/1997 |
| WO | WO 2006/029700 | A2 | 3/2006 |
| WO | WO 2006082049 | A1 * | 8/2006 |

* cited by examiner

*Primary Examiner* — Mahmoud Gimie
*Assistant Examiner* — David Hamaoui
(74) *Attorney, Agent, or Firm* — Knobbe, Martens, Olson & Bear, LLP

(57) ABSTRACT

An exhaust gas recirculation system having at least one cooler with a housing and at least one valve with a pivotably actuated valve member on an inlet side is characterized in that an actuator for the valve is mounted to the housing of the cooler, which is connected to the valve via at least one lever and at least one connection member such as a coupling rod, a ball-and-socket joint being provided between at least one lever and at least one connection member such as a coupling rod.

15 Claims, 3 Drawing Sheets

EXHAUST GAS RECIRCULATION SYSTEM

CROSS-REFERENCE TO RELATED APPLICATIONS

This application claims the benefit and priority to European Patent Application Number EP 07 014 901.8, filed on Jul. 30, 2007. The disclosure of the above-referenced application is hereby expressly incorporated by reference in its entirety.

BACKGROUND OF THE INVENTION

1. Field of the Invention

The invention relates to an exhaust gas recirculation system.

It is known in the field of internal combustion engines to recirculate exhaust gas to the fresh-air side as a function of the operating state so as to reduce fuel consumption and pollutant emissions. In this connection the exhaust gas can further be passed, at least in part, also as a function of the operating state through an exhaust gas cooler in order to specifically adjust the temperature of the recirculated exhaust gas.

2. Description of the Related Art

A device for exhaust gas recirculation is known from EP 0 916 837 A1, in which an adjusting member for a valve that determines the recirculated quantity of exhaust gas is mounted to a flange of the exhaust gas cooler.

JP 9-88727 relates to an exhaust gas cooler, inside of which a translatorily movable valve is provided, the adjusting member of which is mounted to a jacket of the exhaust gas cooler.

EP 1 251 263 A2 discloses an exhaust gas recirculation system.

SUMMARY OF THE INVENTION

The present invention is based on the object of providing an exhaust gas recirculation system that permits particularly reliable operation under all possible operating conditions.

The above object is solved by the exhaust gas recirculation system described in claim 1.

In accordance therewith, the exhaust gas recirculation system has at least one cooler with a housing and at least one pivotably or rotationally actuatable valve on an inlet side. The housing of the cooler is used, for example, to receive those lines through which the exhaust gas to be recirculated flows as well as optionally a suitably insulated bypass line. During operation, there is a coolant such as, for example, water in the housing, which flows around the aforementioned lines and thus cools the exhaust gas being guided through the corresponding lines. The bypass pipe is either provided outside the housing of the cooler or within the same and is suitably insulated, and therefore cooling of the recirculated exhaust gas is considerably less extensive here. In particular, the cooler of the exhaust gas recirculation system described herein can be designed as described in EP 1 277 945 A1 of Applicant, the disclosure of which is made the subject matter of the present application in particular with regard to the cooler.

The arrangement of the valve on the inlet side offers the advantage that the exhaust gas is comparatively hot here, and therefore the risk of deposits and dirt accumulation, which could result in the valve being stuck to its valve seat, is considerably reduced. If such problems should nonetheless occur which may result in the valve adhering to its valve seat to some extent, the design of the valve according to the invention as a pivotably actuated valve offers advantages.

This is understood to mean that not only the actuator for the valve is designed so as to be pivotably but also that the valve or valve member itself moves pivotably between the closed and the opened position and vice versa. As described in more detail below, reliable operation, in particular with regard to reliable opening, can thus be ensured by simple means. In particular, the valve can be the valve described in EP 1 245 820 A1 of Applicant's legal predecessor, the disclosure of which is also made, by way of reference thereto, the subject matter of the present application, in particular with regard to the valve described therein. Furthermore, a pivotably actuated valve member can be disposed in a convenient manner and with comparatively simple means such that it affects the flow of the exhaust gas as little as possible also in the opened state, thereby minimizing the flow resistance at the valve. In this regard, reference is made to EP 1 544 449 A1 of Applicant, the disclosure of which is made the subject matter of the present application, in particular with regard to the shielding of the valve member in the opened state.

Even though the arrangement of the valve on the inlet side offers the aforementioned advantages, this region is unfavorable for the actuator of the valve owing to the occurring temperatures. For this purpose, it is provided according to the invention that the actuator for the valve is provided on the housing of the cooler. The actuator can thus be cooled in an advantageous manner. In particular, excess heating of the actuator is avoided and high operational reliability is achieved. As mentioned above, the housing of the cooler can, for example, receive the (usually liquid) coolant which is used to cool the exhaust gas flowing through the corresponding lines. Thus, the housing of the cooler is also cooled, which advantageously results in the corresponding cooling effect for the actuator. The actuator can also be referred to as an adjusting member and can be designed, for example, as an electric motor, in particular a DC motor.

Preferred developments of the exhaust gas recirculation system according to the invention are described in the further claims.

The arrangement of the axis of rotation of a pivotably actuated, e.g. largely circular valve always poses a major challenge. In particular, there are often leak-tightness problems if the axis of rotation extends "through" the valve member and the edge of the valve member is thus interrupted. In view of this, it is preferred that the valve member be provided at least single eccentrically with respect to its axis of rotation. In other words, the axis of rotation can be offset with respect to the valve member, viewed in the closed state, in the direction of flow or opposite thereto, and therefore the edge of the valve member does not need to be interrupted and reliable closing can be ensured. Alternatively or additionally, the axis of rotation can be provided offset, i.e. eccentrically, with respect to the valve member, again viewed in the closed state, in a direction perpendicular to the direction of flow.

As already indicated, it is preferred for reasons of reliable closing that said valve member closes a valve seat around its entire circumference, i.e. that its edge is substantially uninterrupted.

The actuator is connected to the valve via at least one lever and at least one connecting member such as a coupling rod. This offers considerable freedom of design and simultaneously allows the valve to be advantageously disposed on the "hot" side and the actuator to be disposed on a cooled component, as described above.

The freedom of design is further increased in that a ball-and-socket joint is provided between at least one lever and at least one coupling rod.

It is beneficial for reliable operation, in particular when the valve is slightly opened, if the coupling rod and at least one lever, preferably a lever of the actuator, are at least largely aligned with each other in an at least almost closed state of the valve. In the described slightly opened state, pressure pulsations may occur in the recirculated exhaust gas, which act upon the valve member. If the coupling rod and in particular a lever provided on the actuator are aligned with each other, these forces acting upon the valve member from the exhaust gas cannot change the position of the valve member since this is to some extent blocked or locked. The reason is that the direction of the force acting upon the coupling rod as a result of the pressure pulsations extends substantially through the axis of rotation of the actuator, and therefore rotation of the actuator cannot be generated. The described measure of largely aligning the coupling rod and at least one lever in a slightly opened state of the valve member has proved extremely beneficial in particular in combination with a valve member provided at least single eccentrically, which is not completely balanced as regards the exhaust gas pressure. The reason for this is that even the tendency of an unbalanced valve member to change its positions due to pulsations of the exhaust gas is eliminated. Thus, the described mechanism between the actuator and the valve can be referred to as self-locking. Regarding this and further details of the described mechanism, reference is made to EP 1 462 643 A1 and EP 1 640 593 A1 of Applicant, the disclosure of which, in particular with regard to the opening and closing mechanism and in particular with regard to the increased opening and/or closing force achieved thereby, is made the subject matter of the present application.

To ensure reliable operation and the opportunity to control or regulate the position of the valve, it is currently preferred that the actuator have at least one position sensor.

An exhaust gas recirculation valve that determines the quantity of the recirculated exhaust gas can, for example, be provided as the described valve. Thus, the actuator of an exhaust gas recirculation valve is preferably mounted to the housing of the cooler.

To regulate the temperature of the recirculated exhaust gas, it is further preferred to additionally provide a (cooler) bypass valve such that the temperature of the recirculated exhaust gas can, as a whole, be adjusted more specifically. In this regard, it is advantageous in view of the compactness of the exhaust gas recirculation system if at least two valves, for example an exhaust gas recirculation valve and a bypass valve, are integrated in one housing.

It has proved beneficial for the bypass valve to be connected to a vacuum actuator or an electric actuator.

BRIEF DESCRIPTION OF THE DRAWINGS

The invention will now be explained in further detail with reference to the embodiments shown by way of example in the attached drawings. The drawings show.

DETAILED DESCRIPTION OF THE PREFERRED EMBODIMENT

Figure 1:
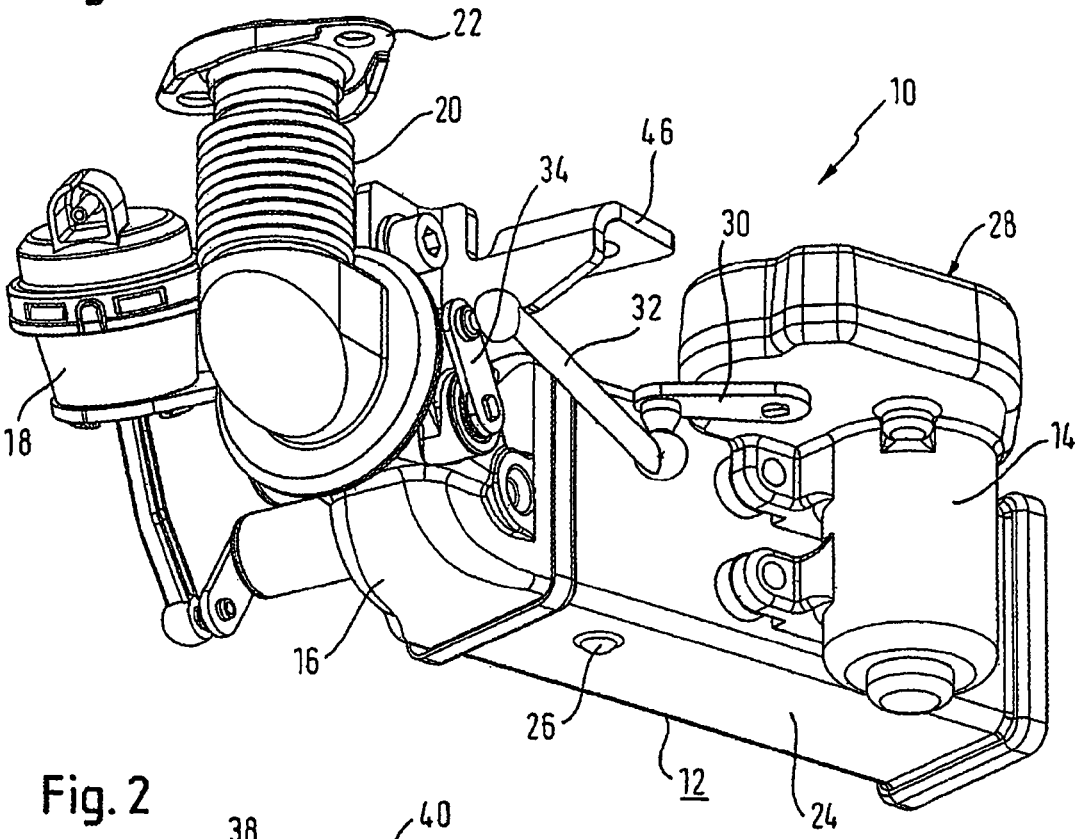
FIG. 1 a perspective bottom view of an exhaust gas recirculation system according to the invention in a first embodiment.

The exhaust gas recirculation system 10 shown in FIG. 1 has a cooler 12, an exhaust gas recirculation valve (not shown in FIG. 1), an actuator 14 therefor, a bypass valve 16 as well as a vacuum actuator 18 for the bypass valve 16. The exhaust gas to be recirculated is supplied through the inlet 20. In the embodiment example shown, said inlet has at its end a flange 22 for connection with the exhaust gas recirculation line. In the embodiment shown, the inlet 20 has a bend of approximately 90°, at the end of which there is provided the exhaust gas recirculation valve actuated by the actuator 14. The exhaust gas recirculation valve can be designed as described above and controls the recirculated quantity of exhaust gas. Downstream in the direction of flow, there is the bypass valve 16, which, in the embodiment shown, controls that quantity of exhaust gas which is guided through a correspondingly insulated bypass pipe (not shown) in order to achieve a clearly lower cooling effect than is the case for those lines (not shown) which are also guided through the cooler 12 but which are not or only slightly insulated.

In the embodiment shown, the cooler 12 has a housing 24, disposed in which are at least one bypass pipe as well as those lines through which the exhaust gas to be cooled flows. Coolant, for example water, flows around the mentioned lines and pipes, which is supplied and discharged via suitable inlets and outlets, one of which is designated by "26" in FIG. 1. The actuator 14 for the exhaust gas recirculation valve is disposed on the accordingly cool housing 24 of the cooler and is thus protected from unfavorable temperatures that are too high. The actuator 14 is designed, for example, as a DC motor, and the motor shaft is connected to a transmission 28, which can be seen in more detail in FIG. 2. The output of the transmission is formed by a lever 30, which is connected with a coupling rod 32 via a ball-and-socket joint in the case as shown. Connection to a lever 34 disposed on the rotating shaft of the exhaust gas recirculation valve is made via a further ball-and-socket joint. Owing to this and in particular owing to the use of the lever and the coupling rod 32, the opportunity arises to advantageously dispose the actuator 14 at a clear distance from the (hot) inlet side. Furthermore, there is great freedom of design, in particular in combination with the ball-and-socket joints, as regards the positional relationship between the exhaust gas recirculation valve and the actuator thereof.

Figure 2:
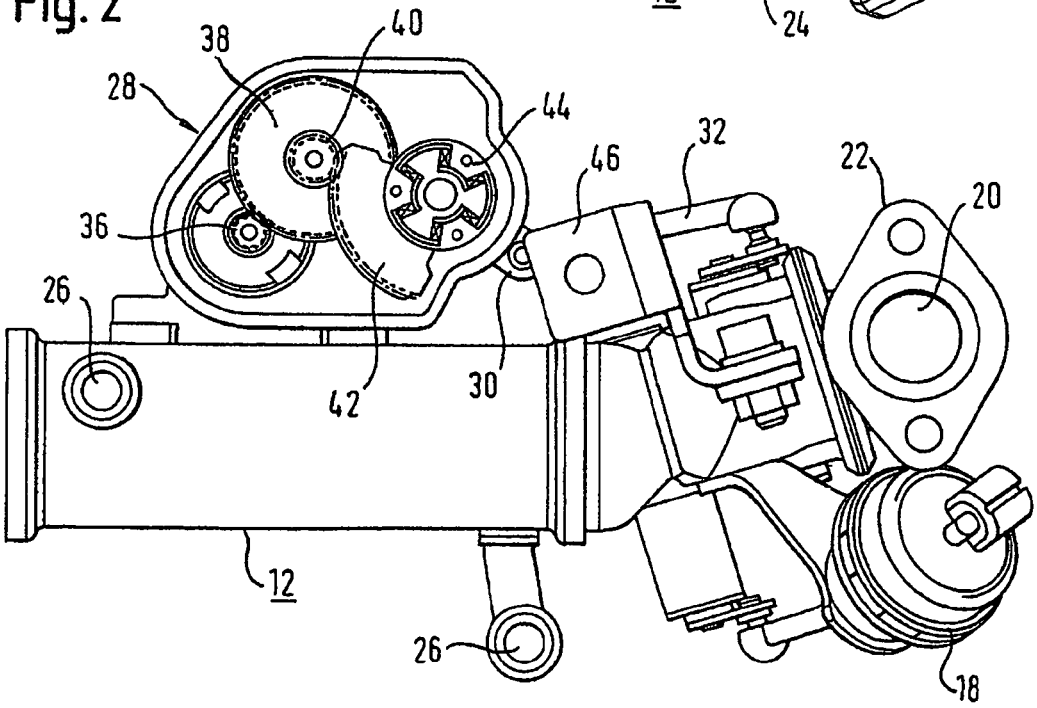
FIG. 2 a top view of the exhaust gas recirculation system according to FIG. 1 where the cover of an actuator transmission is removed.

This can additionally be seen in FIG. 2, which is a top view where the cover of the transmission is removed. Accordingly, one can see the motor shaft with a comparatively small pinion 36 which acts upon a comparatively large pinion 38. This is connected to a further small pinion 40 which is in engagement with a toothed segment 42. Said segment 42 is connected to the lever 30 by which the force is transmitted to the coupling rod 32 and, via the lever 34 (cf. FIG. 1), to the exhaust gas recirculation valve. The size of the toothed segment 42 corresponds approximately to the provided range of motion. It can further be seen in FIG. 2 that the actuator has a position sensor 44, in the case shown at the toothed segment 42. Finally, further inlets or outlets 26 for the liquid coolant can be seen in FIG. 2. In the embodiment shown, there is further provided a support 46 for attachment of the exhaust gas recirculation system to a surrounding component.

Figure 3:
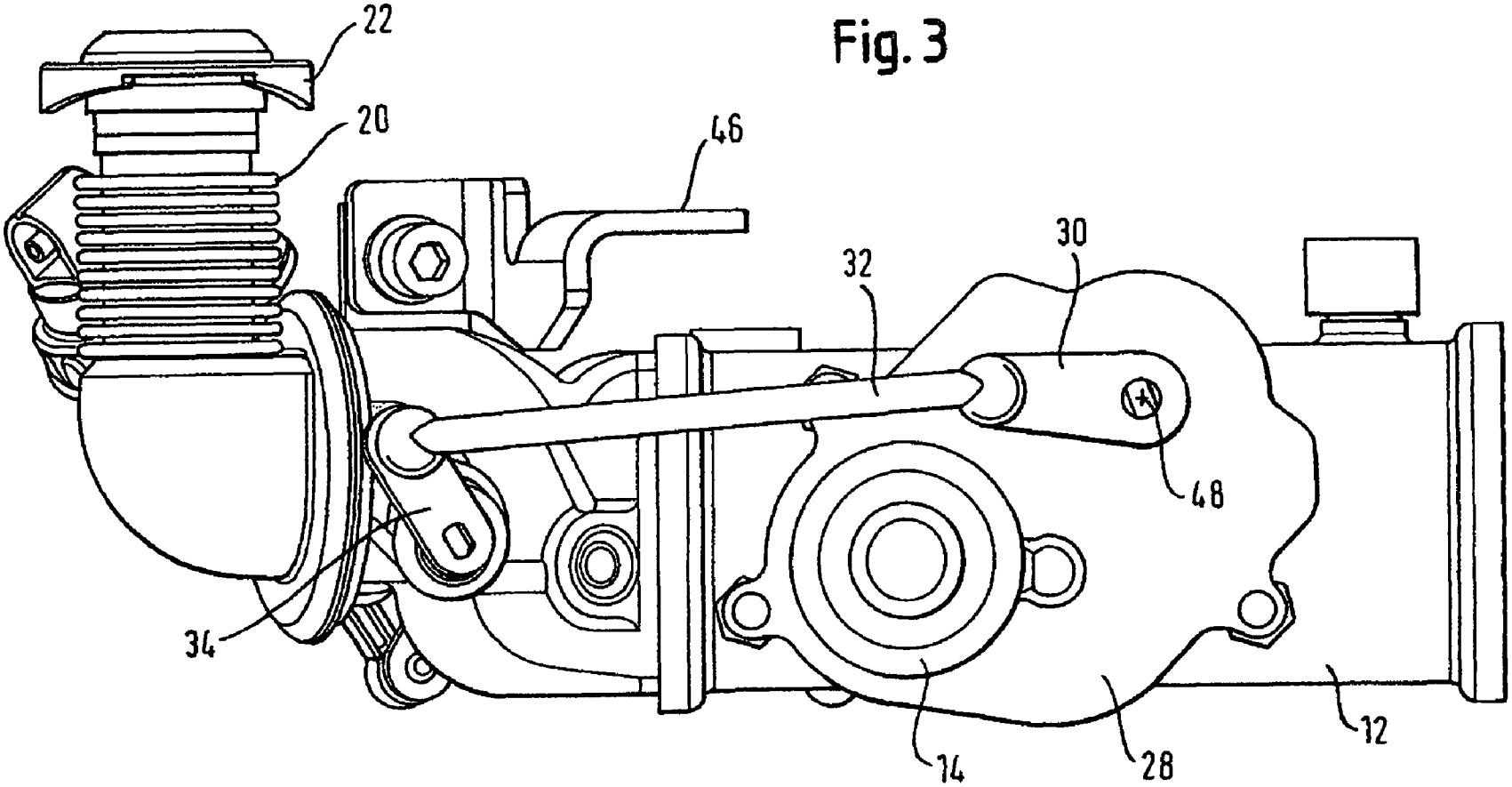
FIG. 3 a side view of a second embodiment of the exhaust gas recirculation system according to the invention.

FIG. 3 shows a further embodiment that is designed differently in particular with regard to the transmission of the force from the actuator 14 to the exhaust gas recirculation valve (also not shown in FIG. 3). The "output" of the actuator or the transmission thereof is again formed by a lever 30 which is in turn connected to a coupling rod 32 via a ball-and-socket joint. The connection between the coupling rod 32 and the exhaust gas recirculation valve also takes place via a ball-and-socket joint and a lever 34 connected to the axis of rotation of the exhaust gas recirculation valve. In the embodiment shown, however, the lever 30 and the coupling rod 32 are aligned almost in parallel. The lever 34 could be located on the same plane as the lever 30 and the coupling rod 32, however, in the embodiment of FIG. 3, it is slightly "tilted" toward the viewer according to the representation of FIG. 3.

A preferred measure can be seen in FIG. 3 to the effect that the coupling rod 32 and the lever 30 provided at the actuator are largely aligned with each other in the closed or slightly opened state of the exhaust gas recirculation valve shown in FIG. 3. Consequently, pressure pulsations that may act upon the valve member do not change the position of the valve member. The reason for this is that the force generated thereby extends in the direction of the coupling rod 32 and thus in the direction of the lever 30 and therefore to a large extent through the axis of rotation 48 of the lever 30. Since the force largely extends through said axis, no torque is applied to the lever by the pressure pulsations for lack of a lever arm, and thus there is no risk of the position of the valve member changing due to such pressure pulsations.

Therefore, the exhaust gas recirculation system according to the invention offers high operational reliability also in this regard.

Figure 4:
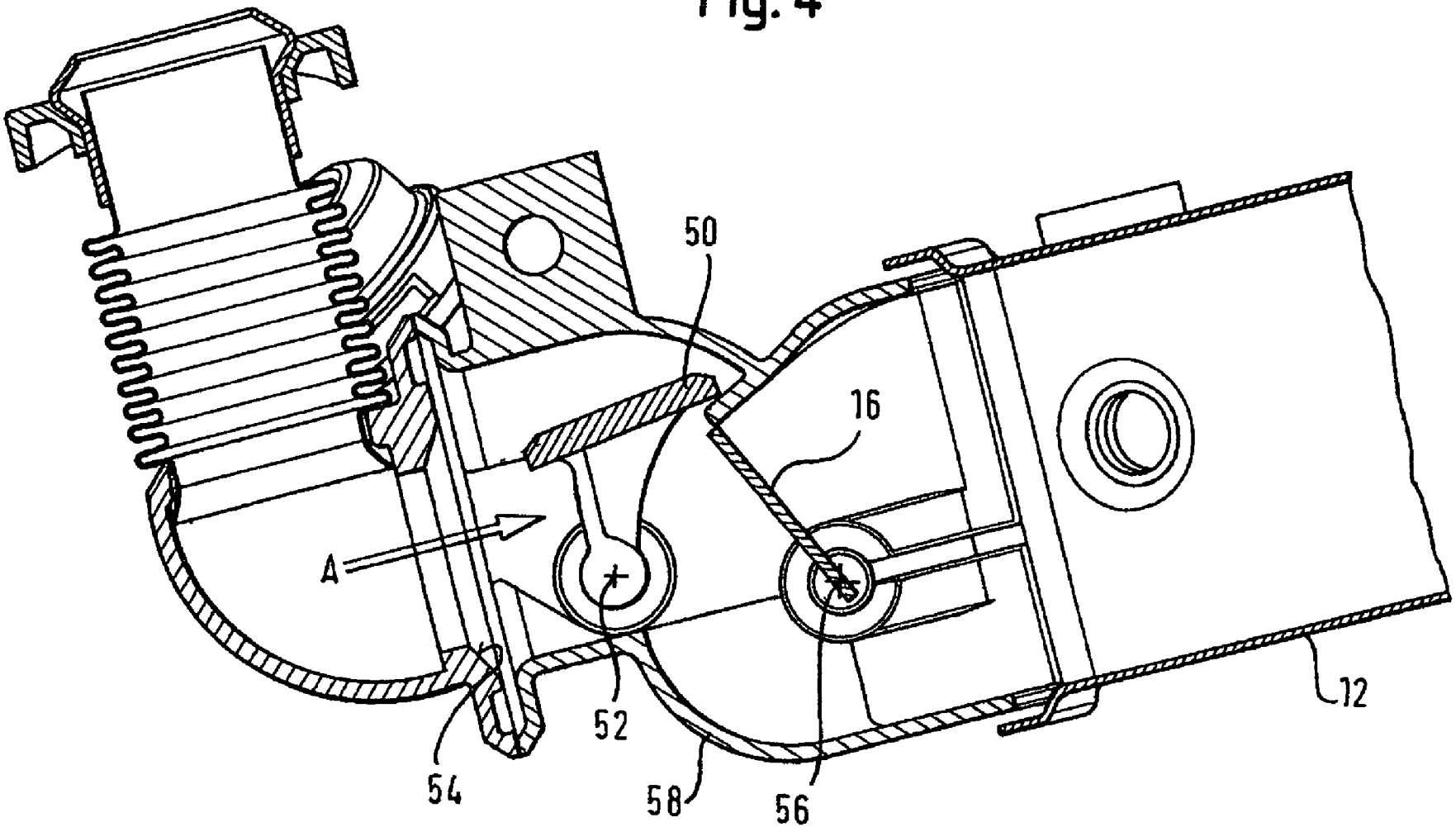
FIG. 4 a sectional view of a part of the exhaust gas recirculation system according to the invention.

In the sectional view shown in FIG. 4, the exhaust gas recirculation valve 50 can be seen in its opened position. For the reasons given above, the axis of rotation 52 is eccentric in two directions with respect to the valve 50. On the one hand, the axis of rotation is offset with respect to the valve 50 in the flow direction A such that the axis of rotation 52 does not extend through the valve 50 which accordingly has an uninterrupted circumference and closes the valve seat 54 along its entire circumference. Moreover, the axis of rotation 52 according to the representation in FIG. 4 is offset toward the bottom, which means that the valve in the opened state is at most located to the side of the flow and only affects said flow to a limited extent. As can be seen in FIG. 4, both the valve seat 54 and the edge of the valve 50 on its side facing the valve seat 54 are designed in a tapered form to achieve as reliable a sealing as possible.

Furthermore, the bypass valve 16 can be seen in FIG. 4, which has an axis of rotation 56 at its one end and is designed as a kind of trumpet valve. In the position shown in FIG. 4, the bypass valve 16 closes that region leading to the pipes that are cooled in the cooler 12. In the other position, i.e. in the position that is rotated anti-clockwise by approximately 60° as compared to the position shown in FIG. 4, the bypass valve closes the bypass line such that the recirculated exhaust gas completely flows through the pipes in the cooler, around which flows, for example, water, and is accordingly cooled. It can further be seen from FIG. 4 that the bypass valve 16 and the exhaust gas recirculation valve 50 are integrated into a common, integral housing 58.

What is claimed is:

1. An exhaust gas recirculation system comprising at least one cooler with a cooler housing and at least one valve with a pivotably actuated valve member located on an inlet side within a valve housing and pivoting about a valve axis which valve axis is perpendicular to a first plane, an actuator for the valve being mounted to the cooler housing, which actuator is connected to the valve via at least one lever and at least one connection member, which actuator comprises a rotatable output, wherein the axis of rotation of the rotatable output of the actuator is transversely located relative to the valve axis and wherein the rotatable output comprises one of the at least one lever located in a second plane, a ball-and-socket joint being provided between the at least one lever and the at least one connection member, wherein the first plane and the second plane are non-parallel with each other.

2. The exhaust gas recirculation system according to claim 1, wherein the valve member is provided eccentrically at least in one direction with respect to the axis of rotation thereof.

3. The exhaust gas recirculation system according to claim 1, wherein the valve member closes a valve seat around its entire circumference.

4. The exhaust gas recirculation system according to claim 2, wherein the connection member and at least one lever are at least largely aligned with each other at least in an almost closed state of the valve.

5. The exhaust gas recirculation system according to claim 1, wherein the actuator has at least one position sensor.

6. The exhaust gas recirculation system according to claim 1, wherein an exhaust gas recirculation valve is provided as the valve, the actuator of which is mounted to the housing of the cooler.

7. The exhaust gas recirculation system according to claim 1, wherein a cooler bypass valve is provided on the inlet side, which is integrated into a common housing together with the valve.

8. The exhaust gas recirculation system according to claim 7, wherein the bypass valve is connected to a vacuum actuator or an electric actuator.

9. The exhaust gas recirculation system according to claim 1, wherein the at least one connection member comprises a coupling rod.

10. The exhaust gas recirculation system according to claim 1, further comprising a transmission interposed between the actuator and the at least one connection member.

11. The exhaust gas recirculation system according to claim 1, wherein the cooler housing defines a coolant inlet and a coolant outlet, the actuator being located between the coolant inlet and the coolant outlet.

12. The exhaust gas recirculation system according to claim 1, wherein the at least one lever comprises a first lever and a second lever, wherein the first lever is the output of the actuator, the second lever is coupled for rotation with the pivotably actuated valve member and the at least one connection member couples the first lever and the second lever.

13. The exhaust gas recirculation system according to claim 12, wherein the second lever rotates about the valve axis in the first plane.

14. The exhaust gas recirculation system according to claim 13, wherein the first plane is perpendicular to the second plane.

15. The exhaust gas recirculation system according to claim 1, wherein the first plane is perpendicular to the second plane.

* * * * *